US005518683A

United States Patent [19]

Taylor et al.

[11] Patent Number: 5,518,683

[45] Date of Patent: May 21, 1996

[54] HIGH TEMPERATURE ANTI-FRETTING WEAR COATING COMBINATION

[75] Inventors: Kevin P. Taylor, Dayton; Jerry D. Schell, Evendale, both of Ohio

[73] Assignee: General Electric Company, Cincinnati, Ohio

[21] Appl. No.: 386,780

[22] Filed: Feb. 10, 1995

[51] Int. Cl.[6] ..... B22F 7/02

[52] U.S. Cl. ..... 419/9; 419/5; 419/8; 419/10

[58] Field of Search ..... 419/5, 10, 8, 9; 427/446, 450, 454, 455, 456

[56] References Cited

U.S. PATENT DOCUMENTS

| | | | |
|---|---|---|---|
| H647 | 7/1989 | Johnson et al. | 29/417 |
| 3,143,383 | 8/1964 | Bamberger et al. | 308/241 |
| 4,256,489 | 3/1981 | Van Wyk | 75/173 R |
| 4,481,236 | 11/1984 | Bosshart et al. | 427/576.4 |
| 4,663,060 | 5/1987 | Holinski | 252/12 |
| 4,921,405 | 5/1990 | Wilson | 416/241 R |
| 4,980,241 | 12/1990 | Hoffmueller et al. | 428/607 |
| 5,038,014 | 8/1991 | Pratt et al. | 219/121.64 |
| 5,232,789 | 8/1993 | Platz et al. | 428/637 |
| 5,236,788 | 8/1993 | Manier et al. | 428/626 |
| 5,268,045 | 12/1993 | Clare | 148/518 |
| 5,356,545 | 10/1994 | Wayte | 252/28 |
| 5,397,649 | 3/1995 | Schienle et al. | 428/552 |

*Primary Examiner*—Donald P. Walsh
*Assistant Examiner*—John N. Greaves
*Attorney, Agent, or Firm*—Andrew C. Hess; David I. Narciso

[57] ABSTRACT

A metal alloy article is proved with an improved fretting wear resistant coating combination for use in the temperature range of about 650°–1100° F. on an article contact surface shaped to cooperate with an abutting member. An example is a gas turbine engine blade base carried by an abutting support slot. The coating combination includes an inner portion of a Ni base alloy having a room temperature annealed yield strength of greater than about 30 ksi to less than about 57 ksi and densely deposited from a powder, for example by the high velocity oxygen—fuel thermal spray process rather than by other processes such as air plasma spray. Cured on the inner portion is an outer portion of graphite particles mixed in an inorganic binder capable of stable use in the range of about 650°–1100° F., for example silicates or phosphates, such as of aluminum.

5 Claims, 2 Drawing Sheets

HIGH TEMPERATURE ANTI-FRETTING WEAR COATING COMBINATION

The Government has rights in this invention pursuant to Contract No. N00019-88-C-0283 awarded by the Department of the Navy.

FIELD OF THE INVENTION

This invention relates to anti-fretting wear coatings for metal surfaces, and more particularly, to such coatings for use in the temperature range of about 650°–1100° F.

BACKGROUND OF THE INVENTION

Anti-fretting wear foils, shims, coatings or their combinations have been used in the compressor and/or fan section of gas turbine engines because very small movements or vibrations at the juncture between mating components have resulted in what is commonly called fretting or fretting wear. Typical component combinations include fan or compressor blades carried by a rotor or rotating disc. Such occurrence of wear can require premature repair or replacement of one or both components or their mating surfaces if not avoided. In modem gas turbine engine compressors, it has been noted that Ti alloys have relatively poor anti-fretting wear or anti-friction characteristics. For example, such Ti alloys as commercially available and widely used Ti 6-2-4-2 alloy have relatively high room temperature yield strengths, such as greater than about 100 ksi, which can result in fretting wear with an abutting member such as blade slot during operation.

One commonly used anti-fretting coating combination is a Cu—Ni—In alloy (nominally by weight 36% Ni, 5% In, balance Cu) applied to a mating surface of a component and then covered by a molybdenum disulfide solid film lubricant. The Cu—Ni—In alloy and its application to a gas turbine engine component to avoid such wear is described in U.S. Pat. No. 3,143,383 Bamberger et al, patented Aug. 4, 1964. The disclosure of that patent is hereby incorporated herein by reference. Although such an alloy has been effective for certain lower temperature uses, its yield strength is insufficient for use at higher temperatures and stresses, for example in more advanced gas turbine engines in the range of about 650°–1100° F. Similarly, the use of molybdenum disulfide, which is mixed with an organic binder such as an epoxy, is inadequate in that temperature range: it oxidizes and loses effectiveness above about 650° F., causing extrusion of the coating combination and wear of the underlying base material.

SUMMARY OF THE INVENTION

The present invention, in one form provides an improved anti-fretting coating combination for a metal article. Such an article includes a first contact surface, for example a compressor blade base, shaped to cooperate with a second contact surface of an abutting member, for example a receiving slot of a rotor, in an oxidizing atmosphere during use at a temperature in the range of about 650°–1100° F., in a manner which can develop fretting wear between the contact surfaces. The first contact surface has thereon an improved anti-fretting coating combination comprising an inner metal alloy portion applied from a Ni— base metal alloy powder onto the first contact surface as a densely deposited metal alloy having a yield strength, in the annealed condition, in the range of greater than about 30 to less than about 57 ksi (thousands of pounds per square inch), when measured at room temperature. On the inner portion is an outer portion of graphite particles mixed in an inorganic binder which is capable of stable use in the temperature range of about 650°–1100° F. and cured onto the inner portion to provide the coating combination. In a more specific form, the first contact surface is a Ti alloy and the Ni— base metal alloy includes at least about 15 wt. % Cr to provide, in an oxidizing atmosphere during use in the temperature range of about 650°–1100° F., an amount of oxides of chromium which resists fretting wear and provides oxidation resistance to the coating combination.

Another form of the present invention is a method for applying the improved fretting wear resistant coating combination to the first contact surface including the steps of applying the metal alloy powder by a high velocity oxygen fuel (HVOF) thermal spray process to provide the densely deposited inner coating portion. Then the outer coating portion is applied to the inner portion from a mixture of graphite particles in an inorganic binder capable of stable use in the temperature range of about 650°–1100° F. For example, the inorganic binder is a phosphate or a silicate, such as those compounds of Al. Thereafter, the outer coating portion is cured on the inner portion to provide the coating combination.

DESCRIPTION OF THE PREFERRED EMBODIMENTS

Figure 1:
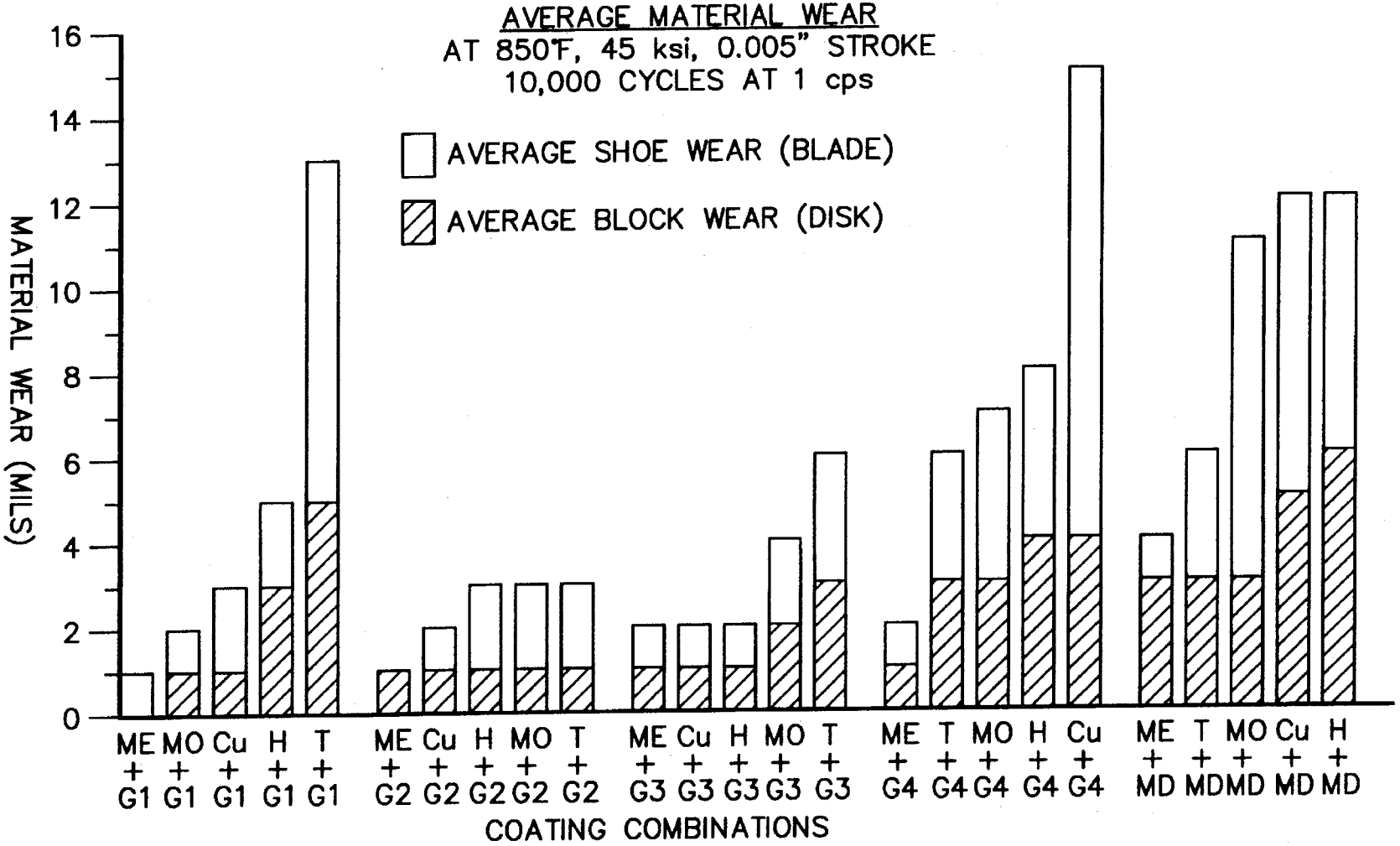
FIG. 1 is a bar graph comparison of wear characteristics of various inner and outer coating combinations including combination within and outside of the present invention.

In some current gas turbine engine compressors, an air plasma sprayed coating of Cu—Ni—In alloy is used on titanium alloy compressor blade bases in conjunction with a solid film lubricant of molybdenum disulfide material carried in an organic or polymeric matrix such as an epoxy. This combination is intended to avoid fretting wear of the compressor blade base with the carrying slot of the compressor rotor which is an alloy of titanium. Such a coating combination has been effective for use in oxidizing atmospheres up to temperatures of about 600° F. However at temperatures above about 650° F. found in more advanced gas turbine engine compressors, the combination has been seen to oxidize and lose effectiveness. This has resulted in extrusion of the coating from between the mating blade base and slot wall, and wear of the underlying base material: the Cu—Ni—In alloy has too low a yield strength, and the dry film lubricant begins to break down at such elevated temperatures at which its binder was not designed to operate.

The present invention provides an improved fretting wear resistant coating combination for use in the temperature range of about 650°–1100° F. by selecting a first metal coating densely deposited thermally using a Ni— base alloy powder. The deposited coating has a yield strength high enough to resist extrusion in that temperature range and under the operating conditions found in more advanced gas turbine engine compressors and yet not too high as to cause wear to the substrate, as will be shown in data presented below. Combined with such a densely deposited metal coating is a graphite dry film lubricant comprised of particles mixed in an inorganic, rather than an organic, binder capable of stable use in the temperature range of about 650°–1100° F. As used herein, the term "stable use" means that the binder will not substantially deteriorate in that temperature range to the point at which it no longer is effective as a binder for the graphite particles. Preferred forms of such a binder are phosphates and silicates, for example as compounds of Al.

The term "densely deposited" has been used herein to define the condition of the inner or metal coating portion of the combination of the present invention. Such a condition can be achieved by using a currently commercially available High Velocity Oxygen-Fuel (HVOF) process and equipment instead of the more commonly used air plasma spray process. In the air plasma spray process, very high temperatures are used, for example up to the point at which ceramics are melted, with low powder particle velocities and many process variables to control. Thickness limitations exist due to coating tensile residual stresses. By way of contrast, the process herein defined as the HVOF process uses lower flame temperatures, lower than those which can melt ceramics, along with very high powder particle velocities which result in denser coatings and better adhesive bond strength and cohesive bond strength. Thicker coating capability is due to compressive or no residual stresses. The HVOF process has relatively few process variables to control. Therefore, a typical HVOF applied coating, according to the present invention, will have a thickness in the range of about 0.002–0.007" and a density greater than a coating applied by the air plasma process.

During evaluation of the present invention, a wide variety of coating combinations were tested. One convenient and effective comparison test was a material wear test conducted at 850° F. on a block and shoe arrangement simulating, respectively, the compressor disk and Ti alloy blade. Conveniently, testing was conducted on commercially available Ti 6-4 alloy, representative of other similar alloys such as Ti 6-2-4-2 alloy. Coatings were applied to a thickness in the range of about 0.002–0.003". FIG. 1 presents average material wear at that temperature in the test conducted at 45 ksi with a 0.005" stroke and at 10,000 cycles at 1 cycle per second. The following Tables I and II identify the symbols used in the graph of FIG. 1:

TABLE I

Alloy Materials and Symbols

| Alloy | Symbol | Nominal Comp. (weight %) | Avg. Yield Strength (ksi @ room temp) |
|---|---|---|---|
| Metcoloy 33 | ME | 16 Cr, 1.5 Si, 22.5 Fe, bal. Ni | 50 |
| Hastelloy B | H | 28 Mo, 1 Co, 1 Cr, 2 Fe, 1 Mn, bal. Ni | 57 |
| Monel 400 | MO | 32 Cu, 1.4 Fe, bal. Ni | 30 |
| Triballoy 800 | T | 17 Cr, 28 Mo, 3 Si, bal. Co | 125 |
| Cu—Ni—In | CU | 36 Ni, 5 In, bal. Cu | 25 |

In the above Table I, the average room temperature yield strength was measured on materials in the annealed condition.

TABLE II

Solid Lubricants and Symbols

| Material | Symbol | Description |
|---|---|---|
| Dag 143 | G 1 | graphite/inorganic binder |
| LOB 1800 - G | G 2 | graphite/inorganic binder |
| Tiolube 660 | G 3 | graphite/inorganic binder |
| C 700/Cermalube | G 4 | graphite/ceramic matrix |
| Molydag 254 | MD | moly.disulfide/epoxy |

The data of FIG. 1 show, in each bar, the total wear as a sum of the individual wear on the shoe (blade) and the block (disk). It should be noted in particular that, in relation to combinations ME+G1 and ME+G2, within the scope of the present invention, there was no wear on the block in the first case and no wear on the shoe in the second case. In every test shown, the combination of ME with G1, G2, G3 and G4 exhibited a lower average wear than any other combination tested. According to the present invention, this can be explained based on the average yield strengths of the materials involved. Table I shows the average yield strength of ME to be 50 ksi, intermediate to the higher average yield strength of 57 ksi for H and the lower average yield strengths of 25 and 30 ksi for CU and MO, respectively. The alloys based on Cu or Co were found to be inadequate. Therefore, the present invention defines the inner portion of the combination coating as a Ni— base metal alloy having an average yield strength in the annealed condition in the range of greater than about 30 ksi (to avoid alloy extrusion during operation) to less than about 57 ksi (at which level it is believed excess wear can result). In connection with testing of the commonly used molybdenum disulfide in an epoxy, organic matrix as a dry film lubricant, the data of FIG. 1 clearly shows the inferiority in wear resistance in any combination with any of the inner metal alloys tested, when compared with the graphite mixed in an inorganic matrix such as a silicate or phosphate of aluminum.

The specimens used in the testing summarized in FIG. 1 were prepared by applying to a clean specimen surface the inner, metal coating portion by the above described high velocity oxygen fuel (HVOF) thermal spray process, and which provided relatively thicker, denser coating with better adhesive bond strength and cohesive bond strength due to high particle velocities. Then the dry film lubricant described above was applied to the metal coated specimen surface and cured in a furnace.

Figure 2:
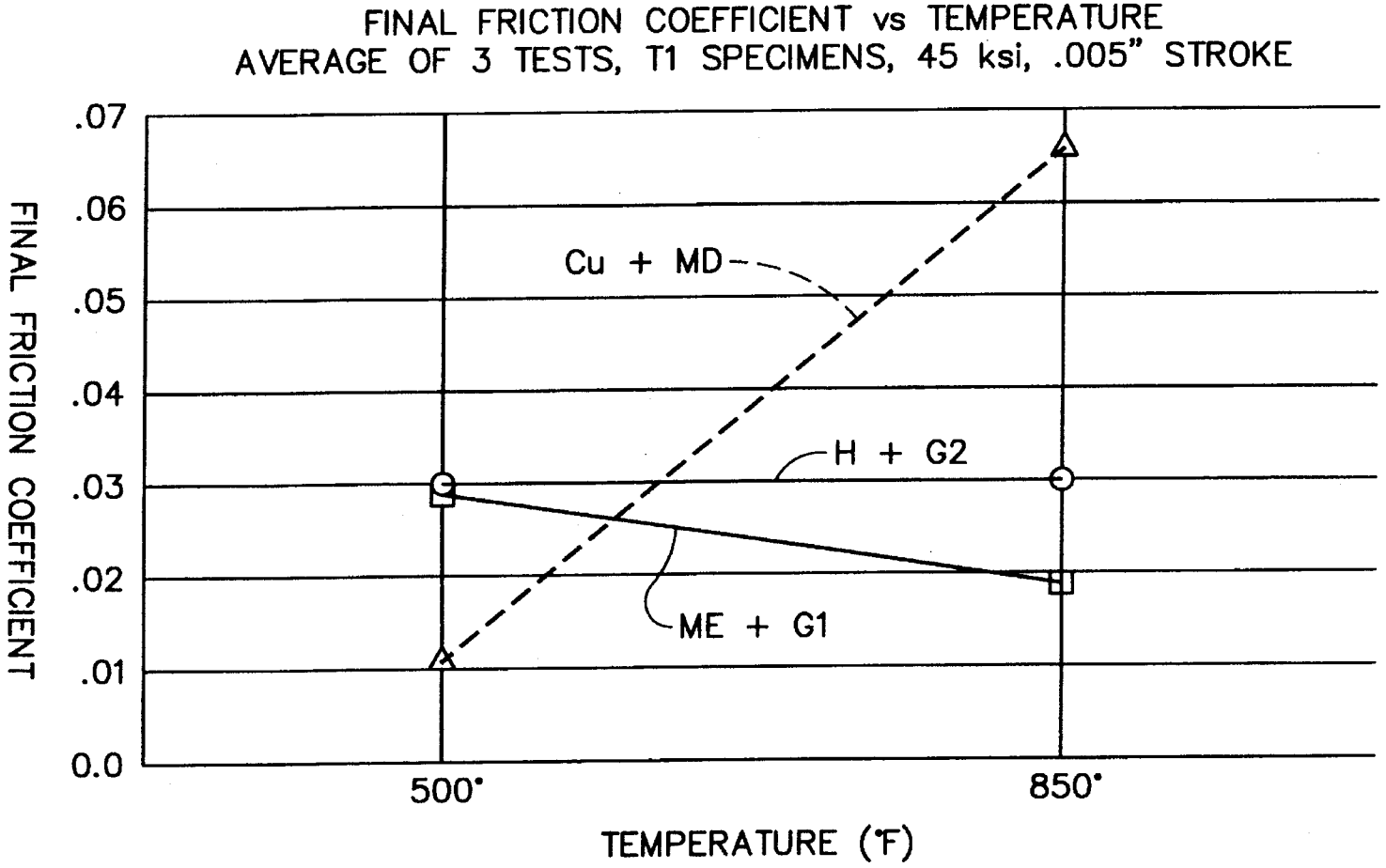
FIG. 2 is a graphical comparison of coefficients of friction for coating combination within and outside of the present invention.

The graphical presentation of FIG. 2 presents friction coefficients compared at 500° F. and at 850° F. for the combination coating ME+G1, within the scope of the present invention, and for the combinations H+G2 and CU+MD, outside of the invention. It is clearly seen that the commonly used CU +MD system breaks down in a manner which can lead to destructive fretting wear of the mating components. In addition, no improvement is shown in the H+G2 system. In contrast, the coating combination of the present invention, represented by ME+G1, shows a reduction in the coefficient and, therefore an improvement in wear resistant capabilities through use of the present invention.

The above examples and embodiments are presented to be typical of, rather than limiting on, the scope of the present invention, as will be appreciated by those skilled in the arts involved and as defined in the appended claims. The improved coating combination of this invention maintains functionality at temperatures up to about 1100° F., higher than any other anti-fretting coating for its intended purpose. The microstructure of the dense thermal sprayed coating inner portion resists oxidation in that temperature regime and, because of its selected strength, it resists extrusion during operation. The solid film lubricant of graphite in an inorganic binder, for the outer portion of the combination, maintains a low coefficient of friction and prevents galling of the mating surfaces. The improved coating combination of this invention is not based solely on the solid film lubricant, as with many other reported anti-fretting coatings. The invention is based on the combination of and synergistic effect between the inner densely deposited metal coating and the particularly selected graphite and its inorganic matrix. As a result of use of this invention, the incidence of repair or rework of either of the mating surfaces, such as a blade base and uncoated disk as result of fretting wear, will be required significantly less often.

We claim:

1. In a method for applying an improved fretting wear coating combination to a metal article contact surface by a HVOF thermal spray process, the combination of steps of:

applying to the contact surface a Ni base alloy coating from a powder of the Ni base alloy to provide a densely deposited inner coating portion having an annealed room temperature yield strength of greater than about 30 ksi to less than about 57 ksi;

applying to the inner coating portion an outer coating portion from a mixture of graphite particles in an inorganic binder capable of stable use in the temperature range of about 650°–1100° F.; and, curing the outer coating portion on the inner coating portion to provide the coating combination.

2. The method of claim 1 in which the inorganic binder is selected form the group consisting of phosphates, silicates and their mixtures capable of stable use in the range of about 650°–1100° F.

3. The method of claim 2 in which:

the contact surface is a titanium alloy; and, the binder is an aluminum compound.

4. The method of claim 3 in which the Ni base alloy includes, by weight, at least about 15% Cr to provide, in an oxidizing atmosphere during use in the range of about 650°–1100° F., an amount of oxides of Cr which resists fretting wear and provides oxidation resistance to the coating combination.

5. The method of claim 3 in which:

the first contact surface is Ti 6-2-4-2 alloy;

the inner metal alloy powder is Metcoloy 33 alloy; and, the binder is selected from the group consisting of aluminum silicate and aluminum phosphate.

* * * * *